US007862036B2

(12) United States Patent
Rowe et al.

(10) Patent No.: US 7,862,036 B2
(45) Date of Patent: Jan. 4, 2011

(54) MEDIA RESTRAINT DEVICE FOR AN INPUT TRAY

(75) Inventors: Jason Lee Rowe, Richmond, KY (US); Rommel Cabanet Balala, Lapu-Lapu (PH); Dennis Dela Paz, Mandaue (PH); Hazel Joy C. Peralta, Koronadal (PH)

(73) Assignee: Lexmark International, Inc., Lexington, KY (US)

( * ) Notice: Subject to any disclaimer, the term of this patent is extended or adjusted under 35 U.S.C. 154(b) by 360 days.

(21) Appl. No.: 11/855,337

(22) Filed: Sep. 14, 2007

(65) Prior Publication Data

US 2009/0072471 A1 Mar. 19, 2009

(51) Int. Cl.
*B65H 1/00* (2006.01)

(52) U.S. Cl. ..... 271/171

(58) Field of Classification Search ..... 271/171; 399/393

See application file for complete search history.

(56) References Cited

U.S. PATENT DOCUMENTS

| | | | | |
|---|---|---|---|---|
| 6,302,390 | B1 * | 10/2001 | Clark et al. | 271/171 |
| 6,523,822 | B1 * | 2/2003 | Galtier et al. | 271/171 |
| 6,536,968 | B2 * | 3/2003 | Lee et al. | 400/624 |
| 2006/0244203 | A1 * | 11/2006 | Kirby et al. | 271/162 |

* cited by examiner

*Primary Examiner*—Stefanos Karmis
*Assistant Examiner*—Michael C McCullough
(74) *Attorney, Agent, or Firm*—John Victor Pezdek

(57) ABSTRACT

A media restraint device in an input tray of an imaging apparatus includes a movable partition including a primary section and a secondary section. At least one locking mechanism selectively locks the primary section to the input tray, and the secondary section to the primary section. The locking mechanism unlocks either the primary section or the secondary section when the other is at a predetermined position.

18 Claims, 4 Drawing Sheets

MEDIA RESTRAINT DEVICE FOR AN INPUT TRAY

BACKGROUND

The present application is directed to methods and devices for aligning media sheets in an image forming device, and more specifically to adjusting an input tray for various media sizes.

Image forming devices, such as a color laser printer, facsimile machine, copier, all-in-one device, etc, move media sheets along a media path. The media sheets initially begin at an input tray that is sized to hold a stack of sheets. Each sheet is individually picked from the stack and introduced into the media path.

The image forming device may handle a variety of media sizes, such as standard letter size, legal size, and A4. The image forming device may also handle a variety of sizes of envelopes, cards, labels, etc. While input trays may be dedicated to a single media size, such as when the image forming device prints a high volume of letter size media, most input trays can accommodate multiple media sizes. The input tray may use moveable side restraints to constrain and initially position the media prior to feeding into the image forming device. The side restraints may contact the media on one or more sides and be adjustable for a variety of different lengths and widths.

Problems may arise when a single input tray is used for both large and small media sizes. The side restraints may interfere with one another when the length and/or width of the media is small. Some input trays include a third side restraint, which may increase cost and complexity. The input tray may also interact with the image forming device to detect the size of the media in the input tray. Multiple side restraints increase the complexity of a mechanism used to detect media size, and increase the likelihood that a user could incorrectly position the side restraints for a given media size.

SUMMARY

The present application is directed to methods and devices for restraining media in an input tray of an image forming device. In one embodiment, a media restraint device includes a movable partition including a primary section and a secondary section. At least one locking mechanism selectively locks the primary section to the input tray, and the secondary section to the primary section. The locking mechanism unlocks either the primary section or the secondary section when the other is at a predetermined position.

DETAILED DESCRIPTION

Figure 1:
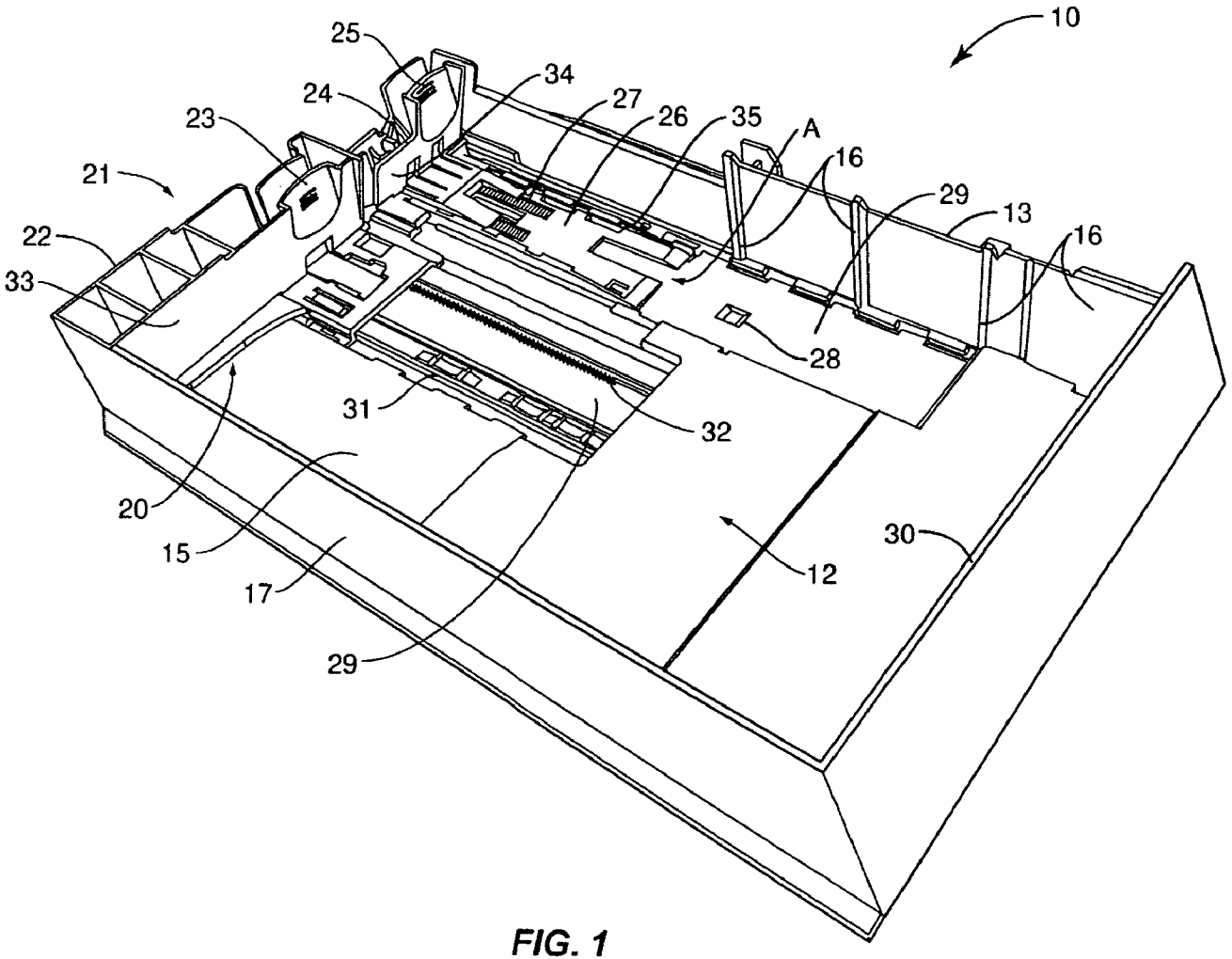
FIG. 1 is a perspective view of an input tray with a media restraint device in a first position according to one embodiment.

The present application is directed to methods and devices for restraining media in an input tray 10 of an image forming device. In one embodiment, a media restraint device 20 includes a movable partition 21 including a primary section 22 and a secondary section 24. The primary section 22 is slidably engaged with a support surface 15 of the input tray 10. The secondary section 24 is slidably engaged with a surface of a lower portion 26 of the primary section 22. At least one locking mechanism 40, 50 selectively locks the primary section 22 to the input tray 10, and the secondary section 24 to the primary section 22. The locking mechanism 40, 50 unlocks either the primary section 22 or the secondary section 24 when the other is at a predetermined position.

A typical input tray 10 including an embodiment of the media restraint device 20 is illustrated in FIG. 1. An input area 12 includes a support surface 15 sized to support a stack of media sheets (not shown). A first side wall 13 extends vertically upward from the support surface 15. The first side wall 13 may include a registration surface 16. An edge of the of the stack of media sheets may be biased toward the registration surface 16 to align the media sheets in a proper orientation prior to feeding into the image forming device. A second side wall 17 extends vertically upward from the support surface 15 and is disposed opposite the first side wall 13.

The input tray 10 may also include an end wall 30 extending between the first side wall 13 and the second side wall 17. The stack of media sheets may also be positioned toward the end wall 30. In one embodiment, the end wall 30 is generally perpendicular to the support surface 15. In another embodiment, the end wall 30 may be angularly disposed to the support surface 15 to facilitate feeding the media sheets. The support surface 15 may include one or more indentations 29 to accommodate the lower portion 26, as well as tracks 31 and channels 32 to guide the movement and maintain alignment of the restraint device 20.

The input tray 10 may be inserted into the image forming device. Once inserted, a pick mechanism (not shown) may be positioned at the input area 12 to introduce the top-most media sheet in the stack of media sheets into a media feed path. Examples of image forming devices with pick mechanisms for introducing media sheets include Model C750 from Lexmark International of Lexington, Ky.

A function of the input tray 10 may be to properly align the media sheets so that each media sheet is properly aligned with the media path. Improperly aligned media sheets may misfeed when entering a media path, or may be skewed. As described above, the media sheets may be biased toward the first side wall 13 and the end wall 30. In one embodiment as illustrated in FIG. 1, a restraint device 20 positions the media sheets relative to the end wall 30. The restraint device 20 may be adjustable for media sheets of various lengths and may also accommodate media sheets of various widths (see FIG. 2 for the orientation of length and width with respect to the input tray 20).

Figure 2:
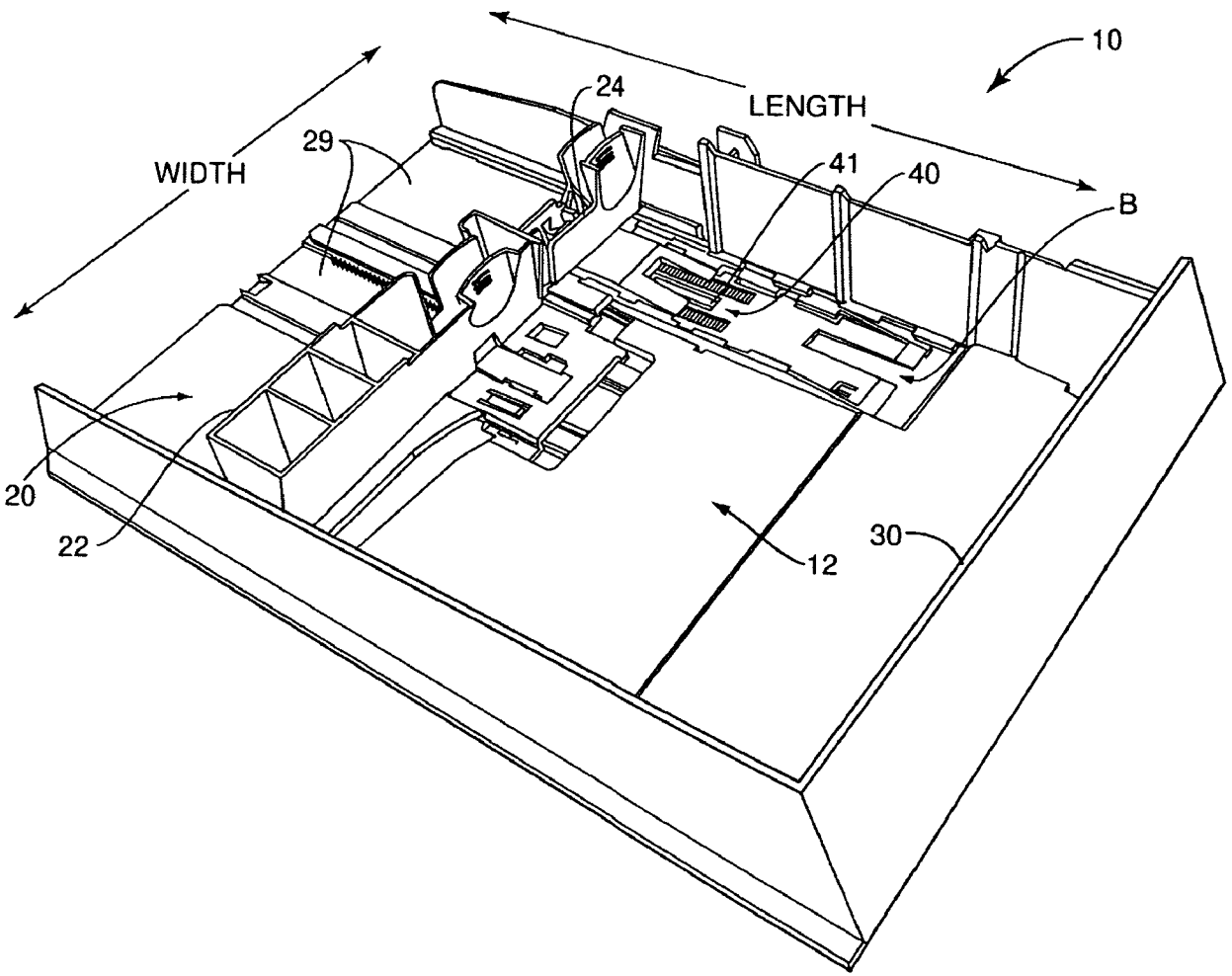
FIG. 2 is a perspective view of an input tray with a media restraint device in a second position according to one embodiment.
Figure 3:
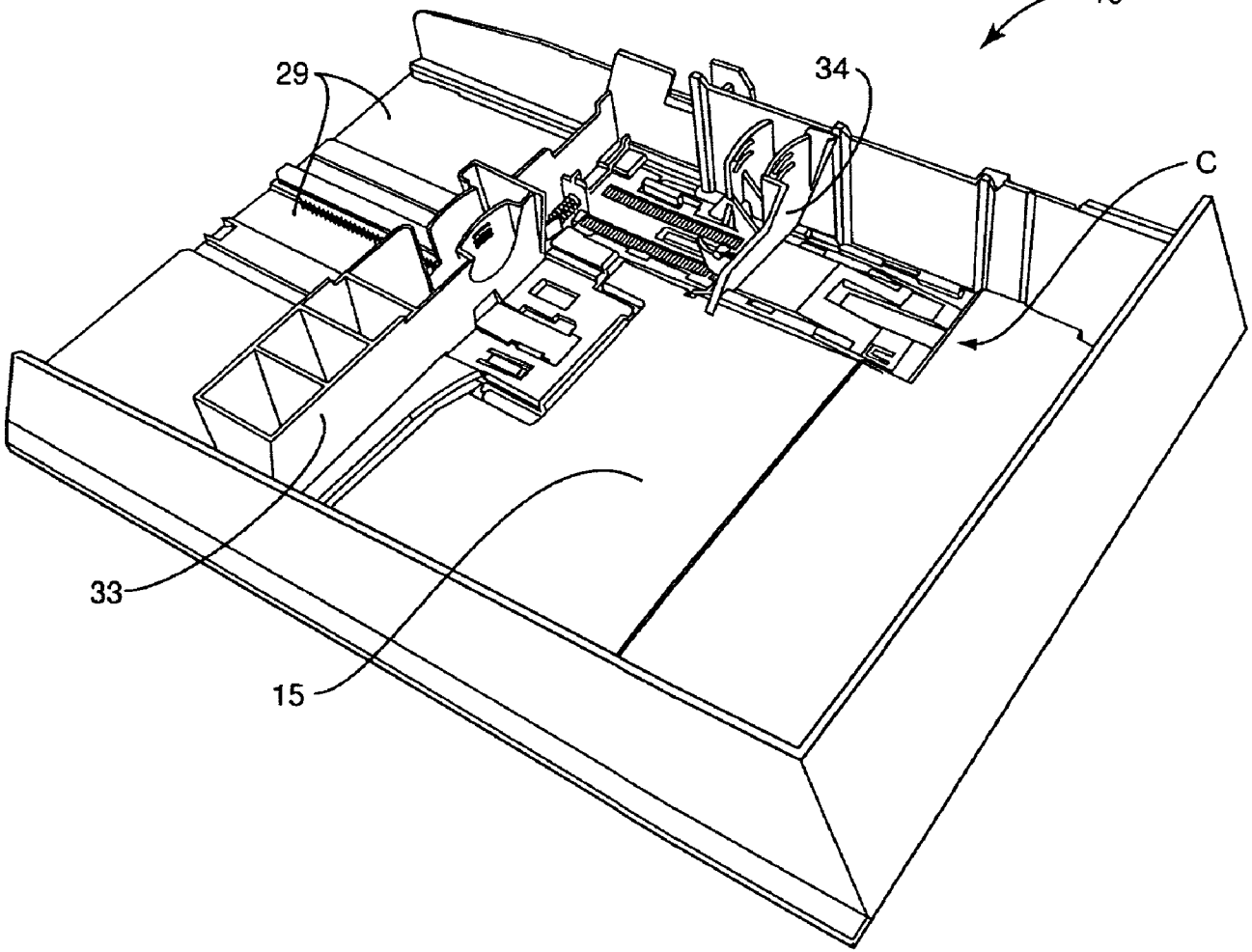
FIG. 3 is a perspective view of an input tray with a media restraint device in a third position according to one embodiment.

FIGS. 1-3 illustrate one embodiment of the restraint device 20. The restraint device 20 includes a lower portion 26 that slidably engages the support surface 15. The restraint device 20 may include a partition 21 that positions the media sheets on the support surface 15. The partition 21 may include a primary section 22 and a secondary section 24. Each of the primary and secondary sections 22, 24 include a surface 33, 34 respectively, for contacting an edge of the stack of media sheets. The surfaces 33, 34 may be disposed essentially perpendicular to the support surface 15, or may be angularly disposed to the support surface 15. In one embodiment, the orientation of the surfaces 33, 34 is essentially the same as the orientation of the end wall 30. Each of the primary and secondary sections 22, 24 also include a securing device 23, 25 respectively, that restricts sliding movement of each section 22, 24 relative to the support surface 15 when engaged. In one embodiment, the securing device 23, 25 includes a first part and a second part. The first part and the second part may be pressed together which toggles a pinching mechanism. When toggled in the open position, the pinching mechanism allows for sliding movement of the section 22, 24. When toggled in the closed position, the pinching mechanism secures the section 22, 24 in a selected position relative to the support surface 15.

The secondary section 24 may be slidably engaged with the surface of the lower portion 26 of the primary section 22. Thus, the secondary section 24 may move in conjunction with the primary section 22. The amount of movement of the primary section 22 is restricted by the indentations 29 in which the lower portion 26 is slidably engaged. Once the lower portion 26 reaches the end of the indentations 29, the lower portion 26 may not be adjustable for media lengths less than the distance between the surface 33 and the end wall 30 at that position. However, the secondary section 24 is further movable on the surface of the lower portion 26. This additional movement allows the length between the end wall 30 and the surface 34 of the secondary section 24 to be less than the smallest achievable length between the end wall 30 and the surface 33 of the primary section 22.

In one embodiment, the securing device 23 secures the primary section 22 to a selected position on the support surface 15. When opened, the securing device 23 allows the primary section 22 to be moved relative to the end wall 30 along the tracks 31 and/or the channels 32 to adjust for media size. The selected position may correspond to a standard media size such as 8½×11, 8½×14, or A4. The selected position may set a distance between the surfaces 33, 34 and the end wall 30 to approximately a length of the media. For example, if the media is 8½×11, then the distance between surfaces 33, 34 and the end wall 30 may be set at approximately 11 inches. In this example, the 11 inch edge of the media would be oriented along the first side wall 13 and the 8½ inch edge would be oriented along the surfaces 33, 34 of the partition 21. It would be apparent to one skilled in the art that the 11 inch edge could instead be oriented along the surfaces 33, 34 and the distance between surfaces 33, 34 and the end wall 30 may be set at approximately 8½ inches.

The primary section 22 is slidably moveable to vary the distance between the surfaces 33, 34 and the end wall 30. When the primary section 22 is at the closest possible position to the end wall 30, the securing device 25 on the secondary section 24 may be opened to allow further adjustment of the secondary section 24 for smaller media lengths.

As labeled in FIG. 2, "length" and "width" refer to a distance in a certain direction with respect to the input tray 10, not necessarily a longest or shortest dimension of the media. The length, then, is the distance from the end wall 30 to either surface 33 or surface 34, whichever is spaced closer to the end wall 30. The width is the distance from the registration surface 16 to the edge of the media stack, assuming that the media stack is biased toward the registration surface 16.

The secondary section 24 may slidably engage one or more slots 35 in the lower portion 26 of the primary section 22. The slots 35 may maintain alignment of the secondary section 24 with the end wall 30, as well as secure the secondary section 24 to the primary section 22. A series of groves 27 may be formed in the surface of the lower portion 26 to engage the securing device 25 and hold the secondary section 24 in a selected position. Certain ones of the groves 27 may correspond to standard media sizes and provide an aid to a user to quickly select an appropriate position of the secondary section 24.

When the secondary section 24 moves in conjunction with the primary section 22, surface 34 of the secondary section 24 may be aligned essentially planar with surface 33 of the primary section 22. In this position, either or both of the surfaces 33, 34 may contact the stack of media sheets and position the stack relative to the end wall 30. The surface 34 may move out of planar alignment with surface 33 when the secondary section 24 is slidably moved on the surface of the lower portion 26 of the primary section 22. However, the surface 34 may remain parallel to the surface 33 to position media sheets relative to the end wall 30.

The image forming device may sense the position of the primary section 22 within the input tray 10 to detect the length of the media loaded into the media tray 10. However, the primary section 22 may be set at a position for a first media length and the secondary section 24 set at a position for a second media length smaller than the first media length. If the length of the media loaded into the input tray 10 corresponds to the second media length, then the image forming device may detect an incorrect media length based on the sensed position of the primary section 22. In one embodiment, the input tray 10 includes at least one locking mechanism 40, 50 securing the primary and secondary sections 22, 24 together to avoid an incorrectly sensed media size. The locking mechanism 40, 50 may be disengaged when either of the primary or secondary sections 22, 24 is in a predetermined position.

FIGS. 1-3 illustrate the predetermined positioning of the primary and secondary sections 22, 24 to allow disengagement of a first locking mechanism 50 (FIG. 4A) and a second locking mechanism 40. FIG. 1 illustrates the restraint device 20 positioned at a maximum distance spaced apart from the end wall 30, designated as position A. This position may correspond to the largest media length that the input tray 20 can accommodate. As described in detail below, when the surface 34 is in the planar alignment with the surface 33, the first locking mechanism 50 unlocks and allows the securing device 23 on the primary section 22 to operate. The securing device 23 may be disengaged, allowing the restraint device 20 to move freely. The second locking mechanism 40 includes a locking arm 41 that prevents sliding movement of the secondary section 24, also described in detail below.

The restraint device 20 may be moved to position B as illustrated in FIG. 2. Position B may correspond to the smallest media length automatically sensed by the image forming device. The secondary section 24 may be locked in place while the restraint device 20 is at any position from position A to position B so that the image forming device may correctly sense the media length as determined by the position of the primary section 22.

As illustrated in FIG. 3, the restraint device 20 may be moved to position C, which may correspond to the maximum sliding movement allowed by the indentation 29 in the support surface 15. At position C, the second locking mechanism 40 may disengage and allow the secondary section 24 to slide freely on the surface of the lower portion 26 of the primary section 22. The movement of the secondary section 24 allows for positioning of media sheets within the input tray 20 with a length less than the smallest length automatically sensed by the image forming device.

Figure 4A:
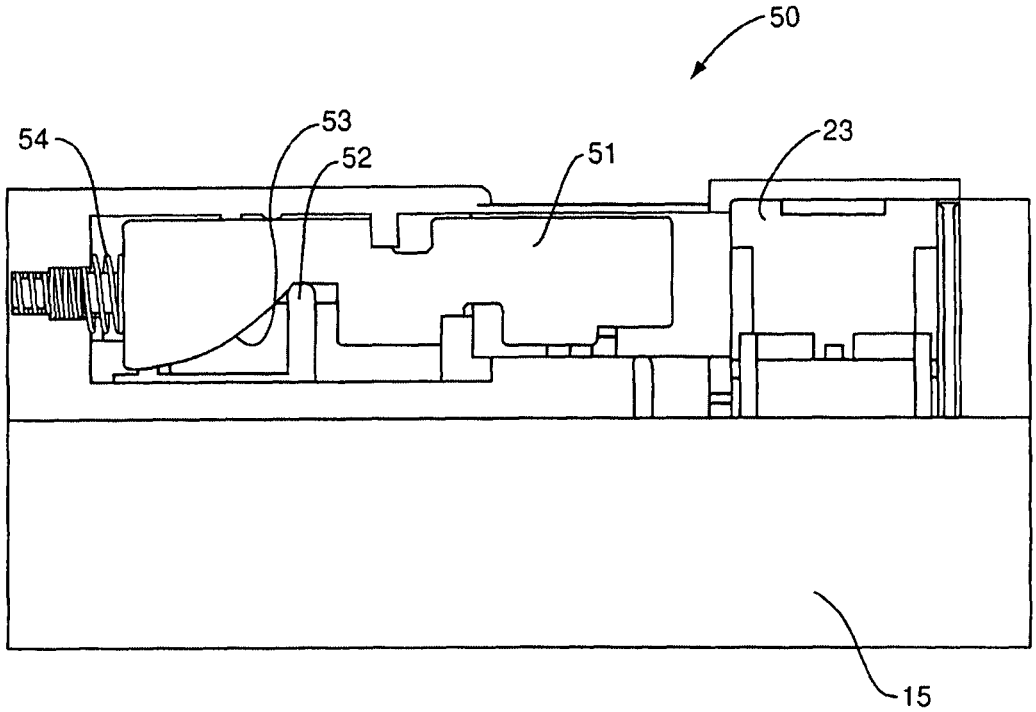
FIG. 4A is a bottom view of an input tray showing a locking mechanism in an unlocked position according to one embodiment.
Figure 4B:
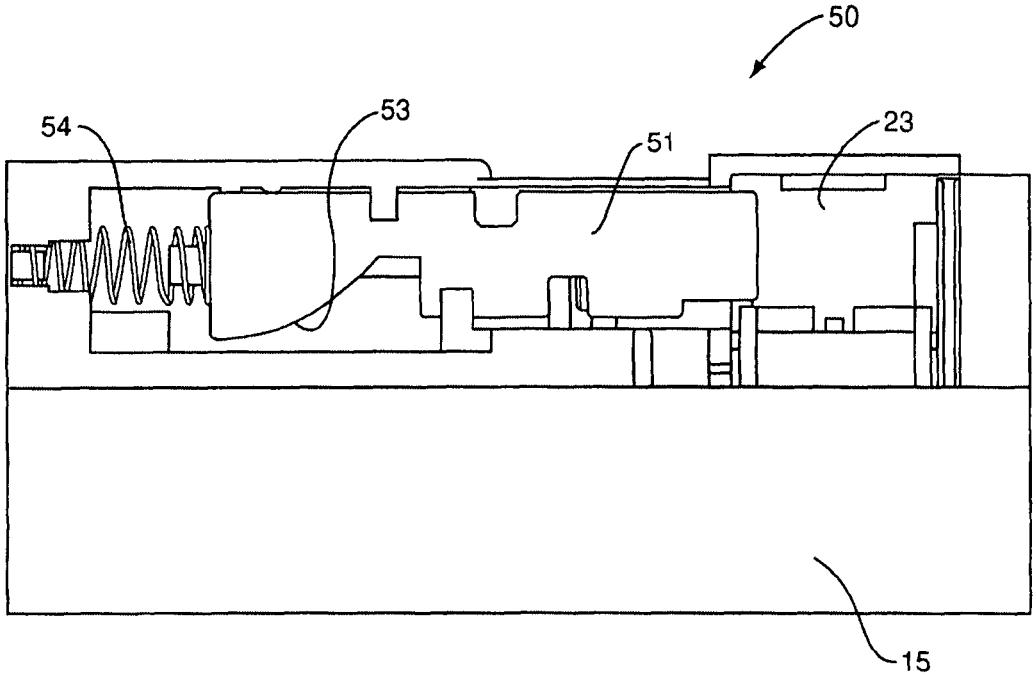
FIG. 4B is a bottom view of an input tray showing a locking mechanism in a locked position according to one embodiment.

FIGS. 4A and 4B illustrate a bottom view of the input tray 10 and an embodiment of the first locking mechanism 50. In FIG. 4A, the primary and secondary sections 22, 24 are in planar alignment as illustrated in FIG. 1. The secondary section 24 includes an engagement arm 52 that contacts a cam surface 53 of a lockout lever 51. As the engagement arm 52 and the cam surface 53 make contact, the lockout lever 51 is moved to the left as viewed in FIG. 4A. As the lockout lever 51 moves to the left, it is disengaged from the securing device 23 of the primary section 22. Thus, when the primary and secondary sections 22, 24 are in planar alignment, the securing device 23 is free to operate and the restraint device 20 may be moved between position A and position C. Meanwhile, the second locking mechanism 40 is engaged, locking the secondary section 24 to the primary section 22 such that surface 33 is in planar alignment with surface 34 while the restraint device 20 moves between position A and position C.

At position C, the second locking mechanism 40 aligns with a secondary lock hole 28 (FIG. 1). The secondary lock hole 28 allows the locking arm 41 to move to a downward position as the secondary section 24 is moved forward out of planar alignment with the primary section 22. As illustrated in FIG. 4B, as the secondary section 24 moves forward, the engagement arm 52 moves away from the cam surface 53 of the lockout lever 51. A spring 54 biases the lockout arm 51 to the right as viewed in FIG. 4B to engage the securing device 23. In this position, the lockout lever 51 prevents operation of the securing device 23, locking the restraint device 20 at position C. The secondary section 24 may now be free to slidingly move along the surface of the lower portion 26.

Once the secondary section 24 is moved back into planar alignment with the primary section 22, the lockout lever 51 may be disengaged from the securing device 23. The media restraint device 20 may then be moved away from position C. The locking arm 41 then engages the secondary section 24 and locks the secondary section 24 in planar alignment with the primary section 22.

FIGS. 4A and 4B illustrate a spring 54 biasing the lockout lever 51. In another embodiment, a resilient material (not shown) such as rubber or plastic as is known in the art may be used in place of the spring 54. The spring 54 or the resilient material may also be arranged to pull the lockout lever 51 into place, rather than pushing the lockout lever 51 as illustrated in FIGS. 4A and 4B.

In one embodiment (not shown), the secondary section 24 is in sliding engagement with the support surface 15, rather than the lower portion 26 of the restraint device 20. In this embodiment, the securing device 25 may function to disengage the secondary section 24 from the primary section 22, as well as allow sliding movement of the secondary section 24.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A media restraint device for an input tray of an image forming device, comprising:

a contact surface; and a partition extending upwardly from and movable relative to the contact surface and including a primary section and a secondary section, each section for contacting an edge of a media stack adjacent thereto, the partition accommodating a first variety of media lengths by being movable between a first position and a second position, the secondary section further being independently movable from the primary section and relative to the contact surface and beyond the second position to accommodate a second variety of media lengths, at least a portion of the second variety of media lengths shorter than the first variety of media lengths, the partition being essentially continuous across a width of the input tray when the primary and secondary sections are in a substantially planar alignment.

2. The media restraint device of claim 1, further comprising a first locking mechanism to secure the secondary section in the substantially planar alignment with the primary section when the partition is positioned between the first and second positions.

3. The media restraint device of claim 2, wherein the first locking mechanism includes a disengageable locking arm to allow the secondary section to be positioned in a non-planar alignment with the primary section when the partition is moved to a third position spaced a greater distance from the first position than the second position.

4. The media restraint device of claim 3, further comprising a second locking mechanism to secure the primary section at the third position when the secondary section is moved out of the substantially planar alignment with the primary section.

5. The media restraint device of claim 4, wherein the second locking mechanism includes a lockout lever including a cam surface disposed to engage an arm extending outward from the secondary section when the secondary section is positioned in the substantially planar alignment with the primary section.

6. The media restraint device of claim 5, wherein the lockout lever is positioned to restrict movement of a release lever when the arm engages the cam surface, and is positioned to allow movement of the release lever when the arm disengages the cam surface, the release lever operative to allow movement of the partition between the first and second positions.

7. The media restraint device of claim 1, wherein the primary section includes a lower portion, the secondary section slidably engaged with the lower portion.

8. A media restraint device for an input tray of an image forming device, comprising:

a primary section extending upwardly from and slidably engaged with a support surface of the input tray and movable between a first position and a second position relative to the input tray and accommodating a first variety of media lengths by being movable between the first position and the second position;

a secondary section slidably engaged with the primary section, extending upwardly from the support surface and movable between the second position and a third position relative to the input tray when the primary section is in the second position and accommodating a second variety of media lengths that are shorter than the first variety of media lengths by being movable between the second position and the third position, the secondary section including a securing device for engaging at least one of a multiplicity of grooves on a surface of the primary section to hold the secondary section in a selected position;

a first locking mechanism to prevent movement of the primary section when the secondary section is not in substantially planar alignment with the primary section; and a second locking mechanism to allow movement of the secondary section toward the third position when the primary section is in the second position.

9. The media restraint device of claim 8, wherein the primary section includes a release lever to allow repositioning of the primary section.

10. The media restraint device of claim 9, wherein the first locking mechanism is positioned to restrict movement of the release lever when the secondary section is positioned apart from the second position.

11. The media restraint device of claim 8, wherein the second position is intermediate between the first and third positions.

12. A method of restraining media in an input tray of an image forming device, comprising:

positioning a secondary section at a fully withdrawn position on a primary section;

engaging a first locking mechanism to releasably secure the secondary section at the fully withdrawn position;

disengaging a second locking mechanism to allow the primary section to move between a first position and a second position, the first position selected to accept media including a first length and the second position selected to accept media including a shorter second length, the first position spaced farther apart from a fixed end wall of the tray than the second position;

moving the primary section to a third position, wherein the second position is intermediate to the first and third positions;

disengaging the first locking mechanism to release the secondary section;

engaging the second locking mechanism to releasably secure the primary section at the third position; and moving the secondary section to a fourth position, wherein the third position is intermediate between the second and fourth positions.

13. The method of restraining media of claim 12, wherein positioning the secondary section at the fully withdrawn position comprises slidably engaging the secondary section with a surface of the primary section.

14. The method of restraining media of claim 12, wherein disengaging the second locking mechanism comprises contacting an arm extending from the secondary section with a lockout lever and moving the lockout lever to a position spaced apart from a release mechanism.

15. The method of restraining media of claim 12, wherein disengaging the first locking mechanism comprises positioning a lock arm in contact with the secondary section over a recess in a surface of the input tray and moving the lock arm at least partially into the recess.

16. The method of restraining media of claim 12, further comprising moving the secondary section to the fully withdrawn position and moving the primary section to a position to restrain media with a third length greater than the first length.

17. The method of restraining media of claim 16, wherein moving the secondary section to the fully withdrawn position further comprises disengaging the second locking mechanism.

18. The method of claim 16, wherein moving the primary section comprises selecting at least one of a plurality of predetermined positions corresponding to standard media lengths.

* * * * *